US005174746A

United States Patent [19]

Kemori et al.

[11] Patent Number: 5,174,746

[45] Date of Patent: Dec. 29, 1992

[54] METHOD OF OPERATION OF FLASH SMELTING FURNACE

[75] Inventors: Nobumasa Kemori; Akihiko Akada; Yasuhiro Kondou, all of Niihama, Japan

[73] Assignee: Sumitomo Metal Mining Company Limited, Tokyo, Japan

[21] Appl. No.: 864,126

[22] Filed: Apr. 6, 1992

Related U.S. Application Data

[63] Continuation of Ser. No. 680,761, Apr. 5, 1991, abandoned.

[30] Foreign Application Priority Data

May 11, 1990 [JP] Japan ..... 121934
Jun. 27, 1990 [JP] Japan ..... 168845

[51] Int. Cl.[5] ..... F26B 3/00; F27D 3/00

[52] U.S. Cl. ..... 432/13; 432/210; 266/212; 266/227; 431/10

[58] Field of Search ..... 431/10; 432/210, 175, 432/147, 13; 266/212, 227

[56] References Cited

U.S. PATENT DOCUMENTS 4,509,915 4/1985 Ito ..... 431/10
4,541,796 9/1985 Anderson ..... 431/10
4,622,007 11/1986 Gitman ..... 431/10
4,642,047 2/1987 Gitman ..... 431/10
4,797,087 1/1989 Gitman ..... 431/10
4,798,532 1/1989 Kimura et al. ..... 432/210
4,824,362 4/1989 Kimura et al. ..... 432/210
4,933,163 6/1990 Fischer et al. ..... 431/10
4,988,285 1/1991 Delano ..... 431/10

FOREIGN PATENT DOCUMENTS 59-41495 10/1984 Japan .
1-78161 5/1989 Japan .
1-78162 5/1989 Japan .
2-236234 9/1990 Japan .

*Primary Examiner*—Henry C. Yuen
*Attorney, Agent, or Firm*—Watson, Cole, Grindle & Watson

[57] ABSTRACT

A method for operation of a flash smelting furnace comprising a reaction shaft, a settler connected at one end thereof to the lower portion of the reaction shaft and having a slag discharge port and a matte discharge port disposed on the side thereof, an uptake connected to the other end of the settler and at least one concentrate burner disposed to at least one of the top of the reaction shaft and the ceiling of the settler, in which the concentrate burner comprises at least a concentrate shoot, an oxygen blowing tube inserted in the concentrate shoot and an auxiliary fuel burner inserted into the oxygen blowing tube. In this method, the lower end of the oxygen blowing tube is protruded downward to lower than the lower end of the concentrate shoot and an amount of oxygen at least greater than that required for the auxiliary fuel is blown as an industrial oxygen by way of the oxygen blowing tube into the furnace. Oxygen efficiency can be improved remarkably while the rate of dust occurrence can be reduced.

7 Claims, 1 Drawing Sheet

PRIOR ART

METHOD OF OPERATION OF FLASH SMELTING FURNACE

BACKGROUND OF THE INVENTION

1. Field of the Invention

The present invention concerns a method for operation of a flash smelting furnace, in particular, for smelting non-iron metals.

2. Description of the Prior Art

A flash smelting furnace has been known as one of refining furnaces using sulfide concentrates as a raw material. FIG. 3 shows an example of a structure of the flash smelting furnace of this kind, which is referred to as an Outokumpu type flash smelting furnace. In the figure, the flash smelting furnace 1 basically comprises a reaction shaft 3 having a concentrate burner 2 disposed at the top, a settler 6 connected at one end thereof to the lower portion of the reaction shaft 3 and having a slag discharge port 4 and a matte discharge port 5 disposed on the side thereof and an uptake 7 connected to the other end of the settler 6. In the operation of such an Outokumpu type flash smelting furnace, a smelting raw material 8 such as a sulfide concentrate, a flux and an auxiliary fuel is at first blown together with a portion of a reaction air by way of the concentrate burner 2 into the reaction shaft 3. In the reaction shaft 3, sulfur and iron as the combustible components of the smelting raw material 8 heated by the combustion of the auxiliary fuel are brought into reaction with the reaction air 9, which is also heated, and then accumulated in a molten state in the settler 6. Further, the melt accumulated in the settler 6 as a hearth is separated by the difference of the specific gravity of the ingredients thereof into a matte 10 consisiting of a mixture of $Cu_2S$ and FeS and a slag 11 mainly composed of $2FeO.SiO_2$. The slag 11 is discharged from the slag discharge port 4 and introduced into an electric slag cleaning furnace 12, while the matte 10 is properly discharged from the matte discharge port 5 in accordance with a demand from a converter in the subsequent step. The slag 11 entering the electric slag cleaning furnace 12 is kept to be heated by a heat generated from electric current supply from an electrode 13 and mixed with ore lumps, flux lumps, etc. charged as required to the electric slag cleaning furnace 12, in which the copper component is deposited further to the bottom of the furnace and only the slag containing a slightly remaining copper component is discharged from the outlet 14 to the outside of the furnace. A waste gas 15 at high temperature emanated in the reaction shaft 3 is sent by way of the settler 6 and the uptake 7 and then cooled by a waste heat boiler 16.

In the Outokumpu type flash smelting furnace, since the control for the oxidation degree of the smelting raw material and the control for the smelting temperature can be conducted independently of each other, it is suitable to refining plants using commercial ores in which the compositions of the raw materials vary inevitably.

However, in such a conventional flash smelting furnace, there has been a problem that no sufficient heat calorie required for melting the smelting raw material 8 can be obtained. That is, the residence time for the particles of the smelting raw material 8 blown by way of the concentrate burner 2 is usually about one second, during which the particles have to be melted by heating to the ignition temperature thereof and being brought into reaction with oxygen in the reaction air 9. Then, although it is necessary to preheat the reaction air 9 to the ignition temperature quickly, the upper limit for the temperature of the reaction air 9 is restricted to 400°-500° C. in view of the relation with the heat resistant temperature of materials for the facilities of the smelting furnace and no sufficient pre-heating can be applied, with a result that the rate of dust generation is increased, as well as the oxygen utilization ratio, that is, oxygen efficiency is inevitably lowered.

In view of the above, a method of using an oxygen enriched air as a reaction air has been put to practical use in order to overcome such a problem. For instance, according to a device disclosed in Japanese Patent Publication Sho 59-41495, improvement is intended for the oxygen efficiency, while taking notice on the high reactivity between an industrial oxygen and a sulfide concentrate by blowing an oxygen-enriching oxygen entirely or partially into a concentrate shoot, while supplying air or an oxygen enriched air from a venturi portion of a concentrate burner, thereby uniformly mixing and dispersing the smelting raw material such as the sulfide concentrate and oxygen.

On the other hand, if the mixing between the smelting raw material blown from the concentrate burner 2 into the reaction shaft 3 of the furnace 1 and an oxygen-enriching oxygen or oxygen-enriched reaction air is insufficient, the utilization efficiency of oxygen reacting with the smelting raw material, that is, the oxygen efficiency is lowered. If the oxygen efficiency is low, it is necessary to supply an oxygen-enriching oxygen or oxygen-enriched reaction air in an amount than required, which leads to the increase of an auxiliary fuel for elevating the temperature of the reaction air supplied in excess and to the increase of the rate of dust generation along with the increase of the amount of waste gases.

For overcoming such a problem, there can be mentioned prior art in, for example, Japanese Utility Model Laid-Open Hei 1-78161 and Hei 1-78162 and the Japanese Patent Laid-Open Hei 2-236234.

Japanese Utility Model Laid Open Hei 1-78161 and Hei 1-78162 describe a concentrate burner comprising an air supply tube, a venturi portion concentrically joined to the lower surface at one end of the air supply tube and a concentrate shoot vertically penetrating the end of the air supply tube from above and extended concentrically to the venturi portion, in which a reaction air supplied from the air supply tube passing between the concentrate shoot and the venturi portion is blown into the top of the reaction shaft (hereinafter referred to as a conventional concentrate burner), wherein one or two blow control plates are disposed in the air supply tube in adjacent with the venturi portion so that the reaction air is blown uniformly from the venturi portion.

Further, in Japanese Patent Laid Open No. Hei 2-2326234, at least one set of air supply nozzles are disposed near the middle portion of a reaction shaft each at a 180° symmetrical position with respect to a vertical line passing through the center of the reaction shaft, such that the axial blowing direction of each of the nozzles aligns with the vertical line, and each of the nozzles is made rotatable within a vertical plane including the axial blowing direction of the nozzle. A portion of a reaction air is blown from the nozzles to form a turbulent flow over the entire region in the reaction shaft, so that the smelting raw material flown from the concentrate burner into the reaction shaft is uniformly dispersed in the reaction air and the residence time thereof in the reaction shaft is prolonged, by which the smelting raw material such as the concentrate ore and the reaction air can be effectively brought into reaction and the oxygen efficiency of the reaction air can be improved further, with a result that the rate of dust generation can be reduced and the formation of unmelts can be prevented.

However, in the device as disclosed in Japanese Patent Publication Sho 59-41495, since oxygen for oxygen enrichment is jetted into a concentrate shoot, sulfide concentrates are brought into reaction with oxygen in the concentrate shoot and fused to the inside of the shoot to clog the concentrate shoot thereby making continuous operation impossible. Further, in this device, since concentrate particles are sufficiently suspended in an oxygen gas stream, satisfactory reaction is taken place in the furnace. However, since the gas stream does not spread, concentrate particles are liable to be discharged together with exhaust gases containing $SO_2$ generated by combustion to the outside of the furnace, which brings about a disadvantage that not only the rate of dust generation can not be reduced but also the generation rate is rather increased depending on the operating conditions.

The device as disclosed in Japanese Utility Model Laid-Open Hei 1-78161 and Hei 1-78162 comprise a flow control plate disposed for making the uniform blowing of the reaction air from the venturi portion in the conventional concentrate burner and it can sufficiently enjoy the performance of the conventional concentrate burner. However, the performance of the conventional concentrate burner is only that the rate of dust generation is more than 9% and the oxygen efficiency is less than 80%, and no better performance can be expected.

According to the examples in Japanese Patent Laid-Open Hei 2-230234, it has been reported that the rate of dust generation is 5.8% and the oxygen efficiency is 100% as the best result obtained in the operation. Then, it is apparent that the flash smelting furnace and the operating method according to this invention are excellent over the flash smelting furnace and the operating method using the conventional concentrate burner. However, according to the study made subsequently, it has been apparent that if the ratio of the silicate ore added other than the sulfide concentrate as the smelting raw material is increased in the operation of the example, although the rate of dust generation did not change so much but the oxygen efficiency was reduced. This is assumed to be attributable to the following reasons.

In accordance with this operating method, since a portion of the reaction gas is blown from an air supply nozzle and hit against a jet stream formed by the concentrate burner, to form a turbulent flow spreading over the entire region in the reaction shaft, the smelting raw material blown together with the auxiliary fuel and the reaction air from the concentrate burner into the reaction shaft is uniformly dispersed in the reaction air. In this case, silicate ore, powdery iron concentrate, copper slag, dust or the like, other than the sulfide concentrate added as the smelting raw material are non-combustible substances, which hinder the combustion of the concentrate ore in the reaction shaft. Among all, since the silicate ore has the main ingredient $SiO_2$ the melting point of which is as high as 1720° C., it is apparent that the combustibility of the concentrate ore is greatly hindered. In this operating method, since the concentrate ore under combustion and silicious sand are uniformly dispersed in the reaction shaft as the ratio of the silicate ore added is increased, the silicate ore acts as if it were a powdery fire extinguishing agent. This results in the lowering of the temperature of the concentrate particles under combustion, which suppresses the oxidizing reaction of the concentrate ore itself to reduce the oxygen efficiency.

OBJECT OF THE INVENTION

In view for the foregoing problems, it is an object of the present invention to provide an operating method for a flash smelting furnace capable of remarkably improving the oxygen efficiency and reducing the rate of dust generation in a flash smelting furnace for non-iron metals using an oxygen-enriched air as a reaction air.

SUMMARY OF THE INVENTION

The foregoing object of the present invention can be attained by an operating method for a flash smelting furnace comprising a reaction shaft, a settler connected at one end thereof to a lower portion of the reaction shaft and having a slag discharge port and a matte discharge port disposed on the side thereof, an uptake connected to the other end of the settler and at least one concentrate burner disposed to the top of the reaction shaft and/or the ceiling of the settler, in which the concentrate burner comprises at least a concentrate shoot, an oxygen blowing tube inserted in the concentrate shoot, and an auxiliary fuel burner inserted into the oxygen blowing tube, wherein the lower end of the oxygen blowing tube is protruded downward to lower than the lower end of the concentrate shoot and, among the amount of oxygen required for the combustion of a smelting raw material and an auxiliary fuel, an amount more than the amount required for the auxiliary fuel is blown as an industrial oxygen by way of the oxygen blowing tube into the furnace.

In another aspect of the present invention, all the amount of oxygen required for the combustion of the smelting raw material and the auxiliary fuel is blown into the furnace as an industrial oxygen by way of the oxygen blowing tube.

In a further aspect of the present invention as described above, the lower end of the auxiliary fuel burner is constituted such that it is at an identical level with that for the lower end of the oxygen blowing tube.

In accordance with the constitution as described above, among the smelting raw materials supplied from the concentrate shoot, self-combustible sulfide concentrates such as copper, nickel and lead are rapidly heated and ignited by radiation heat from a reactor wall, an exhaust gas at high temperature or a flame formed by an auxiliary fuel burner. Since an industrial oxygen in an amount required for the combustion of the auxiliary fuel is blown by way of the oxygen blowing tube, the ignited sulfide concentrate is rapidly brought into reaction with the industrial oxygen supplied from the oxygen blowing tube to form a matte and a slag, in which the matte and the slag at high temperature collide against each other to increase the size of particles during falling in the reaction shaft, as well as they also collide against and melt non-combustible substances such as silicate ore, copper slag, powdery iron concentrate and dust added as the smelting raw material. Further, a portion of the non-combustible substances is melted also by the radiation heat due to the combustion of the sulfide concentrate or an exhaust gas at high temperature. In this case, since the industrial oxygen supplied from the oxygen blowing tube means such an oxygen usually at 90% or higher oxygen concentration, the oxidizing reaction (combustion) of the sulfide concentrate is more rapid as compared with the oxidizing reaction with air or oxygen-enriched air. Since air or oxygen-enriched air contains a lot of inert nitrogen other than oxygen, this hinders the reaction between the sulfide concentrate and oxygen. Further, in the case of using the industrial oxygen, the temperature of the exhaust gas mainly composed of $SO_2$ released upon combustion of the sulfide concentrate is higher than the temperature of an exhaust gas in a case of using oxygen or oxygen-enriched air, since there is no requirement for elevating the temperature of nitrogen or the like. With the functions as described above, since the smelting raw material supplied in the reaction shaft causes efficient reaction with the industrial oxygen, flash smelting at a low rate of dust generation and at high oxygen efficiency is possible.

In particular, if the entire amount of oxygen required for the combustion of the smelting raw material and the auxiliary fuel is blown as an industrial oxygen by way of the oxygen blowing tube into the furnace, it is possible to reduce the rate of dust generation and increase the oxygen efficiency even if the addition ratio of the non combustible substances other than the sulfide concentrate as the smelting raw material is increased, with the reasons described above.

Further, if the lower end of the auxiliary fuel burner is constituted so as to be in the same level as that for the lower end of the oxygen blowing tube, the best result is obtained. This is attributable to that a vigorous heavy oil combustion flame is formed near the lower end and the reaction of the smelting raw material passing through the flame is completed within an extremely short period of time, thereby enabling to extend a time for increasing the size of particles by the collision between each other in the reaction shaft.

DESCRIPTION OF THE ACCOMPANYING DRAWINGS

These and other objects, as well as advantageous features of the present invention will become apparent by reading the following descriptions for preferred embodiments with reference to the accompanying drawings, wherein FIG. 1 is a schematic view for a concentrate burner of a flash smelting furnace used in Example 1;

FIG. 2 is a schematic view for a concentrate burner of a flash smelting furnace used in Examples 2 and 3; and FIG. 3 is a view illustrating a constitution of a conventional flash smelting furnace.

DESCRIPTION OF THE PREFERRED EMBODIMENTS

Figure 1:
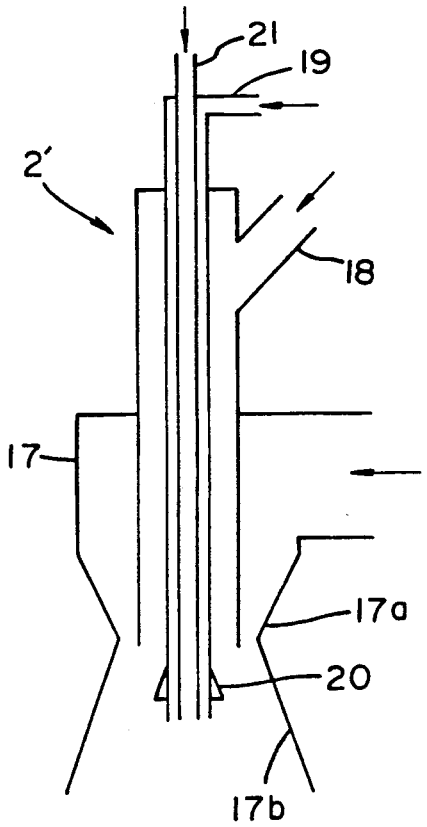

The present invention will now be described more in details with reference to examples illustrated in the drawings.

EXAMPLE 1

Figure 3:
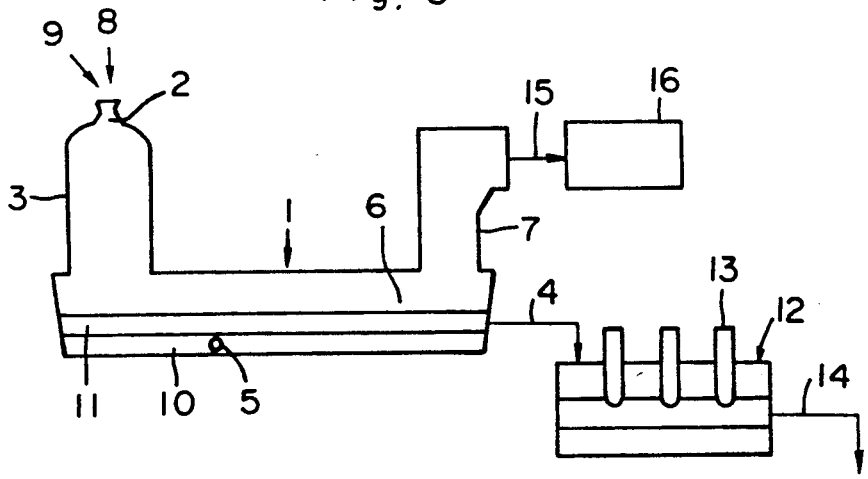

FIG. 1 is a schematic view for a concentrate burner 2' of a flash smelting furnace used in this example, in which a wind box 17 has a restricted portion 17*a* and an opening 17*b* diverged downwardly, a concentrate shoot 18 is suspended in the central portion of the window box 17 such that the lower end is situated slightly below the restricted portion 17*a*, an oxygen blowing tube 19 concentrically penetrates the concentrate shoot 18 and has a dispersion cone 20 around the outer periphery at the lower end thereof that protrudes downward to lower than the top end of the concentrate shoot 18, and an auxiliary fuel burner 21 concentrically penetrates the oxygen blowing tube 19 with the lower end thereof being situated at the same level as that for the lower end of the oxygen blowing tube 19. Test operation was conducted by using a medium scale test furnace with a concentrate processing capacity of about 0.8 t/h and having a reaction shaft 3 equipped with such a concentrate burner 2' at the top and having 1.5 m inner diameter and 4.0 m height and a settler 6 having 1.5 m inner diameter and 5.25 m length (refer to FIG. 3) for four days under the conditions shown in Table 1 below respectively.

TABLE 1

| Conditions for Test Operation | | No. 1 | No. 2 | No. 3 | No. 4 |
|---|---|---|---|---|---|
| Amount of concentrate treated | t/h | 0.8 | 0.8 | 0.8 | 0.8 |
| Amount of silicate ore treated | t/h | 0.07 | 0.07 | 0.07 | 0.08 |
| Amount of heavy oil | l/h | 23 | 23 | 23 | 23 |
| Amount of Air | $Nm^3/h$ | 425 | 425 | 425 | 425 |
| Amount of industrial oxygen (90%) | $Nm^3/h$ | 134 | 134 | 134 | 134 |
| Amount of oxygen from oxygen blowing tube (90%) | $Nm^3/h$ | 0 | 54 | 134 | 134 |

In Table 1, the amount of industrial oxygen means the amount of industrial oxygen used as enriching oxygen, and the amount of oxygen from the oxygen blowing tube means such an amount of oxygen, among the industrial oxygen, that was blown from the oxygen blowing tube 19 into the furnace. In the test operation No. 1 (Comparative Example 1), industrial oxygen and air were mixed and, the entire amount was supplied from the wind box 17. In the test operation No. 2, oxygen in an amount only required for the combustion of heavy oil as an auxiliary fuel (54 $Nm^3/h$) was blown from the oxygen blowing tube 19 into the furnace, while the remaining oxygen was mixed with air and supplied from the window box 17 into the furnace. In the test operation No. 3, the entire amount of the industrial oxygen (134 $Nm^3/h$) was blown from the oxygen blowing tube 19 into the furnace. In these cases (No. 1–No. 3), the lower end of the auxiliary fuel burner 21 was adjusted such that it protruded downwardly to lower than the top end of the oxygen blowing tube 19. Further, in the test operation No. 4, the operating conditions were the same as those in the case of the test operation No. 3 excepting that the lower end of the auxiliary fuel burner 21 was situated so as to be at the same level as the lower end of the oxygen blowing tube 19.

The results for each of the test operations No. 1–No. 4 are be shown in the following Table 2.

TABLE 2

| Result | | No. 1 | No. 2 | No. 3 | No. 4 |
|---|---|---|---|---|---|
| Matte grade | % | 56.8 | 55.4 | 69.7 | 68.9 |
| Temperature of slag | °C. | 1226 | 1235 | 1277 | 1289 |
| Rate of dust generation | % | 15.6 | 11.3 | 14.3 | 10.8 |
| Oxygen efficiency | % | 82.0 | 84.5 | 95.1 | 98.4 |

As apparent from the results shown in Table 2, the rate of dust generation is reduced and the oxygen efficiency is improved by blowing oxygen in an amount more than that for the auxiliary fuel through the oxygen blowing tube 19. That is, ignition and combustion of the auxiliary fuel is usually conducted prior to ignition and combustion of the fine concentrate and, when the amount of industrial oxygen blown from the oxygen blowing tube 19 is increased at least greater than the amount of oxygen required for the combustion of the auxiliary fuel, the concentrate and oxygen cause a vigorous reaction in the high oxygen concentration portion in the thus resultant gas stream, by which the reaction time as a whole can be shortened remarkably.

Particularly, in a case of the test operation No. 4, best operating result can be obtained by not only blowing the entire amount of the enriching oxygen (134 $Nm^3/h$) from the oxygen blowing tube 19 into the furnace but also situating the lower ends for the oxygen blowing tube 19 and the auxiliary fuel burner 21 at an identical level, with the reasons described below. Since a vigorous combustion flame of heavy oil is formed near the top ends of the oxygen blowing tube 19 and the auxiliary fuel burner 21, and the smelting raw material passing in the flame is instantly heated to complete the reaction of the smelting raw material within an extremely short period of time and, as a result, the time for increasing the grain size of particles due to their collision to each other in the reaction shaft 3 can be extended.

Further, the following Tables 3 and 4 show the operating conditions and the operating results for the test operation No. 5, in which the lower ends of the oxygen blowing tube 19 and the auxiliary fuel burner 21 were adjusted to an identical level, and only the industrial oxygen was used as the reaction air and the entire amount was blown from the oxygen blowing tube 19 into the furnace in the medium-scaled test furnace described above.

TABLE 3

| Conditions for Test Operation | | No. 5 |
|---|---|---|
| Amount of concentrate treated | t/h | 0.8 |
| Amount of silicate ore treated | t/h | 0.07 |
| Amount of heavy oil | l/h | 8 |
| Amount of Air | $Nm^3/h$ | 0 |
| Amount of industrial oxygen (90%) | $Nm^3/h$ | 198 |
| Amount of oxygen from oxygen blowing tube (90%) | $Nm^3/h$ | 198 |

TABLE 4

| Result | | No. 5 |
|---|---|---|
| Matte grade | % | 63.3 |
| Temperature of slag | °C. | 1299 |
| Rate of dust generation | % | 4.8 |
| Oxygen efficiency | % | 100 |

According to the test operation No. 5, it was possible to remarkably reduce the rate of dust generation and, in particular, increase the oxygen utilization efficiency to 100%.

In this embodiment, the oxygen efficiency can be improved, in which the dispersion cone 20 in the flash smelting furnace uniformly disperses the smelting raw material to prevent the occurrence of a so-called heap (lump of unmelted product).

In a case of using the same conditions as those for the test operation No. 5 and blowing oxygen from the concentrate shoot 18 instead of the oxygen blowing tube 19 into the furnace, the concentrate was burnt at the inside of the concentrate shoot 18 to clog the concentrate shoot 18 within about 2 hours after the start of the test operation.

EXAMPLE 2

Figure 2:
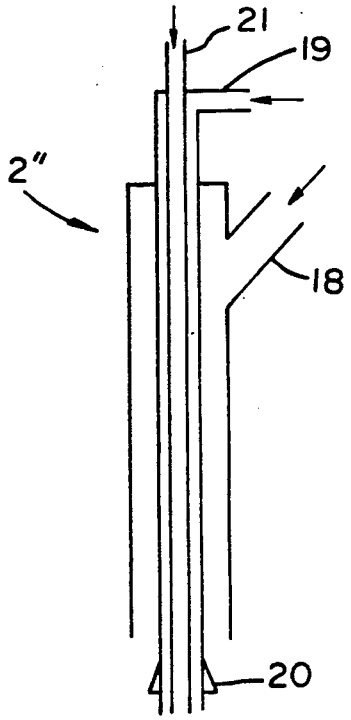

FIG. 2 is a schematic view for a concentrate burner 2'' of a flash smelting furnace used in this example 2 constituted by removing the wind box 17 from the concentrate burner of Example 1 (FIG. 1). Then, operation was conducted under the conditions shown in the following Table 1 by using a small-sized experimental flash smelting furnace comprising a reaction shaft 3 having such a concentrate burner 2'' disposed at the top and having an inner diameter of 1.5 m and a height of 2.5 m from the ceiling to the melted surface of the settler and a settler 6 having an inner diameter of 1.5 m and a length of 5.25 m, with the amount of the concentrate treated of about 0.8 t/h and the aimed matte grade as 50%. In the test operation No. 1, a flame was formed by supplying heavy oil at a rate of 7 l/h from the auxiliary fuel burner. In the test operation No. 2, the heavy oil was not supplied. The operations were conducted for three days and two days respectively.

TABLE 1

| Condition | | Test Operation No. 1 | Test Operation No. 2 |
|---|---|---|---|
| Condition for concentrate burner: | | | |
| Amount of concentrate treated | t/h | 0.868 | 0.797 |
| Amount of silicate ore treated | t/h | 0.067 | 0.057 |
| Amount of heavy oil | l/h | 7.0 | 0 |
| Amount of Air supplied | $Nm^3/h$ | 0 | 0 |
| Amount of industrial oxygen (90% $O_2$) | $Nm^3/h$ | 144.1 | 139.9 |

The results are shown in the following Table 2.

TABLE 2

| Result | | No. 1 | No. 2 |
|---|---|---|---|
| Matte grade | % | 48.4 | 53.0 |
| Temperature of slag | C. | 1276 | 1304 |
| Rate of dust generation | % | 4.3 | 6.7 |
| Oxygen efficiency | % | 99.5 | 98.2 |

COMPARATIVE EXAMPLE 2

Operation was conducted for two days under the condition No. 3 shown in the Table 3 by using the same small-scaled experimental flash smelting furnace as that in Example 2 having a conventional concentrate burner disposed at the top, with the aimed matte grade as 50%. Further, operation was conducted for three days under the condition No. 4 shown in the following Table 3, with the aimed matte grade as 55%, by using the same small-sized experimental flash smelting furnace as that in Example 2 having a concentrate burner disposed at the top and a set of air supply nozzles disposed near the central portion for the side wall thereof shown in Japanese Patent Laid-Open Hei 2-230234. In the following Table 3, L represents the height for the reaction shaft and I represents a distance from the ceiling of the reaction shaft to the air supply nozzle.

TABLE 3

| Condition | | Test Operation No. 3 | Test Operation No. 4 |
|---|---|---|---|
| Condition for concentrate burner: | | | |
| Amount of concentrate treated | t/h | 0.772 | 0.767 |
| Amount of silicate ore treated | t/h | 0.07 | 0.081 |
| Amount of heavy oil | l/h | 12.3 | 7.1 |
| Amount of Air supplied | $Nm^3/h$ | 455.4 | 0 |
| Amount of industrial oxygen (90% $O_2$) | $Nm^3/h$ | 104.8 | 90.4 |
| Air supply nozzle condition: | | | |
| Amount of air supplied | $Nm^3/h$ | — | 446.0 |
| Blowing rate | m/sec | — | 49.3 |
| I/L | | — | 0.323 |
| Number of air supply nozzle | | — | 2 |
| Blowing angle | | — | horizontal |

The results are shown in the following Table 4.

TABLE 4

| Result | | No. 3 | No. 4 |
|---|---|---|---|
| Matte grade | % | 53.8 | 54.2 |
| Temperature of slag | C. | 1315 | 1274 |
| Rate of dust generation | % | 10.0 | 5.3 |
| Oxygen efficiency | % | 78.3 | 95.3 |

As apparent from the comparison for the results between Example 2 and Comparative Example 2, it can be seen that the operation method according to the present invention enables an operating with lower rate of dust generation and higher oxygen efficiency than those in the conventional flash smelting furnace.

EXAMPLE 3

An operation was conducted under the operating conditions as shown in the following Table 1 by using the same small-sized experimental flash smelting furnace as in Example 2, with the aimed matte grade being 50%. In the test operation No. 1, the addition rate of silicate ore to the concentrate was increased and, in the test operation No. 2, silicious sand and powdery iron concentrate were added to increase the addition rate of the non-combustible substances, in which operations were conducted for two days and three days respectively.

TABLE 1

| Condition | | Test Operation No. 1 | Test Operation No. 2 |
|---|---|---|---|
| Condition for concentrate burner: | | | |
| Amount of concentrate treated | t/h | 0.788 | 0.809 |
| Amount of silicate ore treated | t/h | 0.117 | 0.052 |
| Amount of powdery iron concentrate treated | t/h | 0 | 0.077 |
| Amount of heavy oil | l/h | 7.1 | 7.0 |
| Amount of Air supplied | $Nm^3/h$ | 0 | 0 |
| Amount of industrial oxygen (90% $O_2$) | $Nm^3/h$ | 145.7 | 143.3 |

The results are shown in the following Table 4.

TABLE 2

| Result | | No. 1 | No. 2 |
|---|---|---|---|
| Matte grade | % | 52.8 | 52.5 |
| Temperature of slag | C. | 1254 | 1290 |
| Rate of dust generation | % | 5.7 | 4.7 |

TABLE 2-continued

| Result | | No. 1 | No. 2 |
|---|---|---|---|
| Oxygen efficiency | % | 99.2 | 99.8 |

COMPARATIVE EXAMPLE 3

Operation was conducted by a small-sized experimental smelting furnace having a concentrate burner disposed at the top and a pair of air supply nozzles disposed near the central portion on the side wall thereof under the operating conditions shown in the following Table 3 with the aimed matte grade being 55% in the same way as the test operation No. 4 in Comparative Example 2. In the test operation No. 3, the addition ratio of silicate ore to the concentrate was increased and, in the test operation No. 4, the silicate ore and the powdery iron concentrate were added to increase the addition ratio of the non-combustible substances, in which operations were conducted for two days and three days respectively. In the following Table 3, L represents the height of the reaction shaft and I represents a distance from the ceiling of the reaction shaft to the air supply nozzle.

TABLE 3

| Condition | | Test Operation No. 3 | Test Operation No. 4 |
|---|---|---|---|
| Condition for concentrate burner: | | | |
| Amount of concentrate treated | t/h | 0.797 | 0.730 |
| Amount of silicate ore treated | t/h | 0.131 | 0.073 |
| Amount of powdery iron concentrate treated | t/h | 0 | 0.091 |
| Amount of heavy oil | l/h | 7.0 | 7.0 |
| Amount of Air supplied | $Nm^3/h$ | 0 | 0 |
| Amount of industrial oxygen (90% $O_2$) | $Nm^3/h$ | 99.5 | 102.0 |
| Condition for air supply nozzle: | | | |
| Amount of air supplied | $Nm^3/h$ | 504.4 | 475.8 |
| Blowing rate | m/sec | 55.7 | 52.6 |
| I/L | | 0.323 | 0.323 |
| Number of air supply nozzle | | 2 | 2 |
| Blowing angle | | horizontal | horizontal |

The results are shown in the following Table 4.

TABLE 4

| Result | | No. 3 | No. 4 |
|---|---|---|---|
| Matte grade | % | 52.5 | 53.5 |
| Temperature of slag | C. | 1275 | 1247 |
| Rate of dust generation | % | 5.5 | 5.9 |
| Oxygen efficiency | % | 85.4 | 80.6 |

As apparent from the comparison of the results between Example 3 and Comparative Example 3, it can be seen that the operating method according to the present invention can provide a flashing smelting furnace operation at low rate of dust generation and high oxygen efficiency even if the addition ratio of the non-combustible substances to the concentrate is increased, which was impossible by the conventional operating method.

When the operation was conducted by using the same small-sized experimental flash melting furnace as in the test operation No. 3 of Comparative Example 2 equipped with a conventional concentrate burner, under the conditions for the concentrate burner, with the amount of concentrate treated as 0.823 t/h and the amount of silicate ore treated as 0.115 t/h, unmelted matters were deposited on the molten surface under the reaction shaft and operation was possible only for four hours.

As has been described above, the operating method for flash smelting furnace according to the present invention can provide a practically important advantage capable of remarkably increasing the oxygen efficiency and reducing the rate of dust generation in a flash smelting furnace for non-iron metals using an oxygen-enriched air as the reaction air.

What is claimed is:

1. A method of operating a flash smelting furnace which includes a reaction shaft having a top; an uptake; a settler connected at one end to a lower portion of the reaction shaft and at an opposite end to the uptake, said settler including a ceiling, a slag discharge port and a matte discharge port; and at least one concentrate burner disposed in at least one of the top of the reaction shaft and the ceiling of the settler, each concentrate burner including a concentrate shoot, an oxygen blowing tube extending within the concentrate shoot to a lower end which extends beyond an end of the concentrate shoot in a direction towards an interior of the flash smelting furnace, and an auxiliary fuel burner extending within the oxygen blowing tube, said method comprising the steps of:

(1) passing smelting raw material comprising sulfide concentrate and a non-combustible substance through said concentrate shoot towards the interior of the flash smelting furnace, said smelting raw material having a first oxygen demand for complete burning, (2) passing auxiliary fuel through said a auxiliary fuel burner towards the interior of the flash smelting furnace, said auxiliary fuel having a second oxygen demand for complete burning, and (3) passing reaction air containing more than 20% oxygen through the oxygen blowing tube towards the interior of the flash smelting furnace at a rate wherein the amount of oxygen therein is in excess of said second oxygen demand, thereby producing a high temperature flame and high temperature oxygen for combustion with said smelting raw material, which increases combustion efficiency and reduces dust generation.

2. A method according to claim 1, wherein said reaction air in step (3) comprises a mixture of atmospheric air and industrial oxygen.

3. A method according to claim 1, wherein said reaction air consists of industrial oxygen.

4. A method according to claim 1, wherein a lower end of the auxiliary fuel burner is positioned at an identical level with that of the lower end of the oxygen blowing tube.

5. A method according to claim 1, wherein the reaction air is passed through the oxygen blowing tube in step (3) at a rate wherein the amount of oxygen therein is at least equal to the sum of said first and second oxygen demand.

6. A method according to claim 1, wherein the sulfide concentrate is self-combustible copper, nickel, zinc or lead.

7. A method according to claim 1, wherein the non-combustible material is selected from the group consisting of silicate ore, copper slag, powdery iron concentrate and dust.

* * * * *